US008282330B2

(12) United States Patent
Kojima

(10) Patent No.: US 8,282,330 B2
(45) Date of Patent: Oct. 9, 2012

(54) MACHINE FOR ATTACHMENT OF COVER TO BOOK BLOCK

(75) Inventor: Nobuyuki Kojima, Shiga (JP)

(73) Assignee: Horizon International Inc., Shiga (JP)

( * ) Notice: Subject to any disclaimer, the term of this patent is extended or adjusted under 35 U.S.C. 154(b) by 415 days.

(21) Appl. No.: 12/570,393

(22) Filed: Sep. 30, 2009

(65) Prior Publication Data

US 2010/0189530 A1 Jul. 29, 2010

(30) Foreign Application Priority Data

Jan. 27, 2009 (JP) ..... 2009-014906

(51) Int. Cl.

| | |
|---|---|
| ***B42C 11/00*** | (2006.01) |
| ***B42C 11/02*** | (2006.01) |
| ***B42C 11/04*** | (2006.01) |
| ***B42C 13/00*** | (2006.01) |
| ***B42B 9/00*** | (2006.01) |

(52) U.S. Cl. ..... 412/23; 412/4; 412/5; 412/18; 412/19; 412/21; 412/22

(58) Field of Classification Search ..... 412/4–5, 412/18–19, 21–23
See application file for complete search history.

(56) References Cited

U.S. PATENT DOCUMENTS

| | | | | |
|---|---|---|---|---|
| 4,033,004 | A * | 7/1977 | Sugioka | 412/19 |
| 5,980,182 | A * | 11/1999 | Yen | 412/21 |
| 2004/0057814 | A1 * | 3/2004 | Cobene et al. | 412/4 |
| 2005/0180843 | A1 * | 8/2005 | Porat | 412/19 |
| 2007/0036637 | A1 * | 2/2007 | Hata et al. | 412/21 |

FOREIGN PATENT DOCUMENTS

| | | |
|---|---|---|
| JP | 2000-168264 | 6/2000 |

* cited by examiner

*Primary Examiner* — Dana Ross
*Assistant Examiner* — Kyle Grabowski
(74) *Attorney, Agent, or Firm* — Kirschstein, et al.

(57) ABSTRACT

A press plate (8) with a cover (12) is moved upwardly from a standby position to a press position to press the cover against a book block (4) by first and second elevation units. The book block (4) is clamped by nip plates (9, 10), together with the cover (12). The height of each of first and second ends (X, Y) of the press plate (8) at the press position can be set separately by separately controlling the first and second elevation units by a control section (30).

5 Claims, 8 Drawing Sheets

(A)

(B)

(A)

(B)

MACHINE FOR ATTACHMENT OF COVER TO BOOK BLOCK

BACKGROUND OF THE INVENTION

1. Field of the Invention

The present invention relates to a machine for attachment of a cover to a book block and a book binding apparatus having the same.

2. Description of the Related Art

As one of book binding processes, there is a cover attachment process of applying a cover to a book block. In this process, a machine for attachment of a cover to a book block is used. The machine includes a vertically movable press plate, and a pair of nip plates arranged on an upper surface of the press plate. The book block is held above the pair of nip plates in a manner such that a back surface of the book block is opposed to a gap between the pair of nip plates. When the press plate moves upward, the cover is pressed against the back surface of the book block to which glue is applied, the book block and the cover are nipped between the pair of nip plates, and the cover is pressed against both sides of a lower end of the book block, so that the cover is attached to the book block.

In this case, when the cover is attached to the book block in a way that the cover is folded at a right angle along a corner of the back surface of the book block, an excellent finished book with a beautiful appearance can be obtained.

However, in the case of a thin book block, a small amount of glue applied to a back surface of the book block. Therefore, if a height of the press plate when the cover is attached to the book block is excessively low, the glue is not sufficiently supplied to both sides of the back surface of the book block. As a result, the cover is rounded at corners of both sides of the back surface of the book block, and the processing quality of the cover attachment becomes poor. In the case of a thick book block, a large amount of glue applied to a back surface of the book block. Therefore, if the height of the press plate when the cover is attached to the book block is excessively high, the glue sticks out toward both sides of the book block, the cover swells at both sides of the back surface of the book block, and the processing quality of the cover attachment becomes poor.

In other words, in order to obtain good processing quality of the cover attachment, it is necessary to adjust the height of the press plate of the machine when the cover is attached to the book block depending on a thickness of the book block.

A machine for attachment of a cover to a book block having the function of adjusting the height of a press plate when a cover is attached to a book block is known as a conventional technique. FIG. 8 is a side view showing an outline structure of the conventional machine for attachment of a cover to a book block.

As shown in FIG. 8, the conventional machine for attachment of a cover to a book block includes a block 50 mounted in a frame (not shown) and guided for vertical movement. A press plate 51 is attached to an upper surface of the block 50. A pair of nip plates 52*a* and 52*b* is arranged on an upper surface of the press plate 51. A cover is placed on the press plate 51 and the pair of nip plates 52*a* and 52*b*. A rod 53 projects from a lower surface of the block 50.

The machine further includes a lever 55 mounted in the frame so as to swing around a center shaft 54. A first roller 56*a* is attached to a tip end of one arm (55*a*) of the lever 55, and a lower end of the rod 53 abuts against the first roller 56*a* from above. The machine also includes a first sprocket 58 and a cam 59 which are attached to a rotation shaft 57 mounted in the frame. The cam 59 abuts, from above, against a second roller 56*b* attached to a tip end of the other arm 55*b* of the lever 55.

The machine further includes a first motor 60 and a second sprocket 61 mounted on a drive shaft 60*a* of the first motor 60. An endless chain 62 is extended between the first and second sprockets 58 and 61. When the first motor 60 is driven, the cam 59 rotates, and thereby the lever 55 swings. When the lever 55 swings, the rod 53 vertically reciprocates, and thereby the block 50 vertically reciprocates.

The machine also includes a clamp unit (not shown). The clamp unit is mounted in the frame for clamping a book block at both sides thereof in a way that a back surface of the book block is directed downward. Glue is previously applied to the back surface of the book block. The clamp unit arranges the book block above a gap of the pair of nip plates 52*a* and 52*b* in a manner such that the back surface of the book block faces the gap.

As the block 50 moves upward, the press plate 51 moves upward together with the pair of nip plates 52*a* and 52*b*. After the cover is pressed against the back surface of the book block, the pair of nip plates 52*a* and 52*b* clamps a lower end of the book block at both sides thereof, the cover is pressed against side surfaces of the lower end of the book block, and thereby the cover is attached to the book block.

In addition, the machine includes a second motor 63 mounted in the frame, a worm 65 connected to a drive shaft of the second motor 63 through a transmission shaft 64, and a worm wheel 66 engaged with the worm 65. A first gear 68 is mounted on a wheel shaft 67, and a second gear 69 is engaged with the first gear 68. A shaft 70 of the second gear 69 is eccentric from the center shaft 54 of the lever 55 in a vertical direction.

When the second motor 63 is driven and the first gear 68 rotates, the second gear 69 rotates. At this time, since the shaft 70 of the second gear 69 is vertically eccentric from the rotation shaft 54 of the lever 55, when the rotation shaft 54 moves to a position of the shaft 70, a fulcrum of swinging motion of the lever is shifted by an amount of deviation between the rotation shaft 54 and the shaft 70.

By changing the height of the fulcrum of the swinging motion of the lever, the height of the press plate when the cover is attached to the book block can be finely adjusted. Accordingly, even if thicknesses of book blocks are varied, good processing quality of cover attachment can be achieved.

When a book block is formed of quires, however, a top edge side and a bottom edge side of the book block generally have different thicknesses, and differing amounts of glue are applied to the top edge side and the bottom edge side of the book block in a glue application process. In this case, in the conventional machine for attachment of a cover to a book block, if the height of the press plate at cover attachment is adapted to the side of greater thickness, the processing quality of the cover attachment with respect to the side of smaller thickness becomes poor, and if the height is adapted to the side of smaller thickness, the processing quality of the cover attachment with respect to the side of greater thickness becomes poor, and therefore, there is a problem that good processing quality of the cover attachment can not be obtained.

SUMMARY OF THE INVENTION

Hence, it is an object of the present invention to provide a machine for attachment of a cover to a book block capable of achieving good processing quality of cover attachment even if a top edge side and a bottom edge side of the book block have different thicknesses.

To solve the above problem, the present invention provides a machine for attachment of a cover to a book block, comprising: a frame; a press plate attached to the frame for reciprocal vertical movement between a lower end standby position and an upper end press position; a press plate elevating means mounted in the frame; a pair of nip plates arranged on an upper surface of the press plate in parallel to each other for sliding in directions toward and away from each other; a nip plate drive means attached to the press plate for causing the pair of nip plates to slide; a clamp unit mounted in the frame for clamping a book block at both sides thereof in a way that a back surface of the book block is directed downward, glue being previously applied to the back surface of the book block, the clamp unit arranging the book block above a gap between the pair of nip plates in a manner such that the back surface of the book block faces the gap, a cover being arranged on the press plate, the cover covering the pair of nip plates and crossing the pair of nip plates; and a control section sending a control signal to the press plate elevating means and the nip plate drive means so as to upwardly move the press plate from the standby position to the press position together with the pair of nip plates and press the cover against the back surface of the book block by the press plate and thereafter, in the press position, nip a lower end of the book block at both sides thereof together with the cover by the pair of nip plates and press the cover against side surfaces of the lower end of the book block, thereby attaching the cover to the book block, wherein the press plate elevating means comprises: a first elevation unit for vertically moving a first end of the press plate, the first end being located at a top edge side of the book block; and a second elevation unit for vertically moving a second end of the press plate, the second end being located at a bottom edge side of the book block, and wherein the first and second elevation units are separately controlled by the control section so that the height of each of the first and second ends of the press plate at the press position can be set separately.

According to a preferred embodiment of the present invention, the first elevation unit of the press plate elevating means comprises: a first stepping motor arranged below the first end of the press plate and mounted in the frame; a first plate cam fixed to a drive shaft of the first stepping motor; a first rod projecting from a lower surface of the first end of the press plate; and a first roller attached to a tip end of the first rod and abutting against an edge of the first plate cam from above, and wherein the second elevation unit of the press plate elevating means comprises: a second stepping motor arranged below the second end of the press plate and mounted in the frame; a second plate cam fixed to a drive shaft of the second stepping motor; a second rod projecting from a lower surface of the second end of the press plate; and a second roller which is provided on a tip end of the second rod and which abuts against an edge of the second plate cam from above, and wherein the first and second stepping motors are separately controlled by the control section, so that the height of each of the first and second ends of the press plate in the press position can be set separately.

According to another preferred embodiment of the present invention, the press plate is attached to the frame by a shaft at a portion thereof which is separated from the gap between the pair of nip plates by a distance in a direction intersecting at a right angle with the nip plates, the shaft extending in parallel to the nip plate, whereby the press plate swings around an axis of the shaft so that the first and second ends of the press plate vertically reciprocate, respectively.

According to further preferred embodiment of the present invention, the control section includes a touch screen for inputting a value of the height of each of the first and second ends of the press plate in the press position, and the first and second stepping motors are controlled based on the value of the height inputted from the touch screen.

According to further preferred embodiment of the present invention, the first elevation unit of the press plate elevating means comprises: a first liquid-pressure cylinder arranged below the first end of the press plate; and a first pressure control means for operating the first liquid-pressure cylinder, a main body of the first liquid-pressure cylinder being fixed to the frame, a tip end of a piston rod being connected to a lower surface of the first end of the press plate, the first end being vertically moved by reciprocal motion of the piston rod of the first liquid-pressure cylinder, and wherein the second elevation unit of the press plate elevating means comprises: a second liquid pressure cylinder arranged below the second end of the press plate; and a second pressure control means for operating the second liquid pressure cylinder, a main body of the second liquid pressure cylinder being fixed to the frame, a tip end of a piston rod being connected to a lower surface of the second end of the press plate, the second end being vertically moved by reciprocal motion of the piston rod of the second liquid pressure cylinder, and wherein the first and second pressure control means are separately controlled by the control section, so that the height of each of the first and second ends of the press plate in the press position can be set separately.

According to further preferred embodiment of the present invention, the press plate is attached to the frame by a shaft at a portion thereof which is separated from the gap between the pair of nip plates by a distance in a direction intersecting at a right angle with the nip plates, the shaft extending in parallel to the nip plate, whereby the press plate swings around an axis of the shaft so that the first and second ends of the press plate vertically reciprocate, respectively.

According to further preferred embodiment of the present invention, the control section includes a touch screen for inputting a value of the height of each of the first and second ends of the press plate in the press position, and the first and second stepping motors are controlled based on the value of the height inputted from the touch screen.

Another preferred embodiment of the present invention provides a book binding apparatus having: a milling unit for grinding a back surface of a book block; a glue application unit for applying glue to the back surface of the book block grinded by the milling unit; and a cover attachment unit comprising the machine for attachment of the cover to the book block according to the present invention, the cover attachment unit being adapted to attach the cover to the back surface of the book block to which the glue is applied by the glue application unit, the milling unit, the glue application unit and the cover attachment unit being sequentially arranged in a line, the cover attachment unit having the function of a book block insertion unit for setting the book block in a clamp unit, the clamp unit being guided by a slide guide arranged in parallel to the line of the milling unit, the glue application unit and the cover attachment unit having the function of the book block insertion unit, and reciprocating between the milling unit and the cover attachment unit, whereby the book block is inserted into the clamp unit and the back surface is positioned by being abutted against the press plate located at an alignment position between the standby position and the press position when the clamp unit is located at the book block insertion unit, the book block is clamped by the clamp unit and moved to the milling unit from the book block insertion unit beyond the glue application unit and then, the book block is moved from the milling unit to the cover attachment unit through the glue application unit, and during this movement, the back surface of the book block is subjected to grinding processing, glue is applied to the back surface, and the cover is attached to the back surface, wherein the height of the alignment position of the press plate of the book block insertion unit is adjusted by the press plate elevating means.

DETAILED EXPLANATION OF THE PREFERRED EMBODIMENTS

Figure 1:
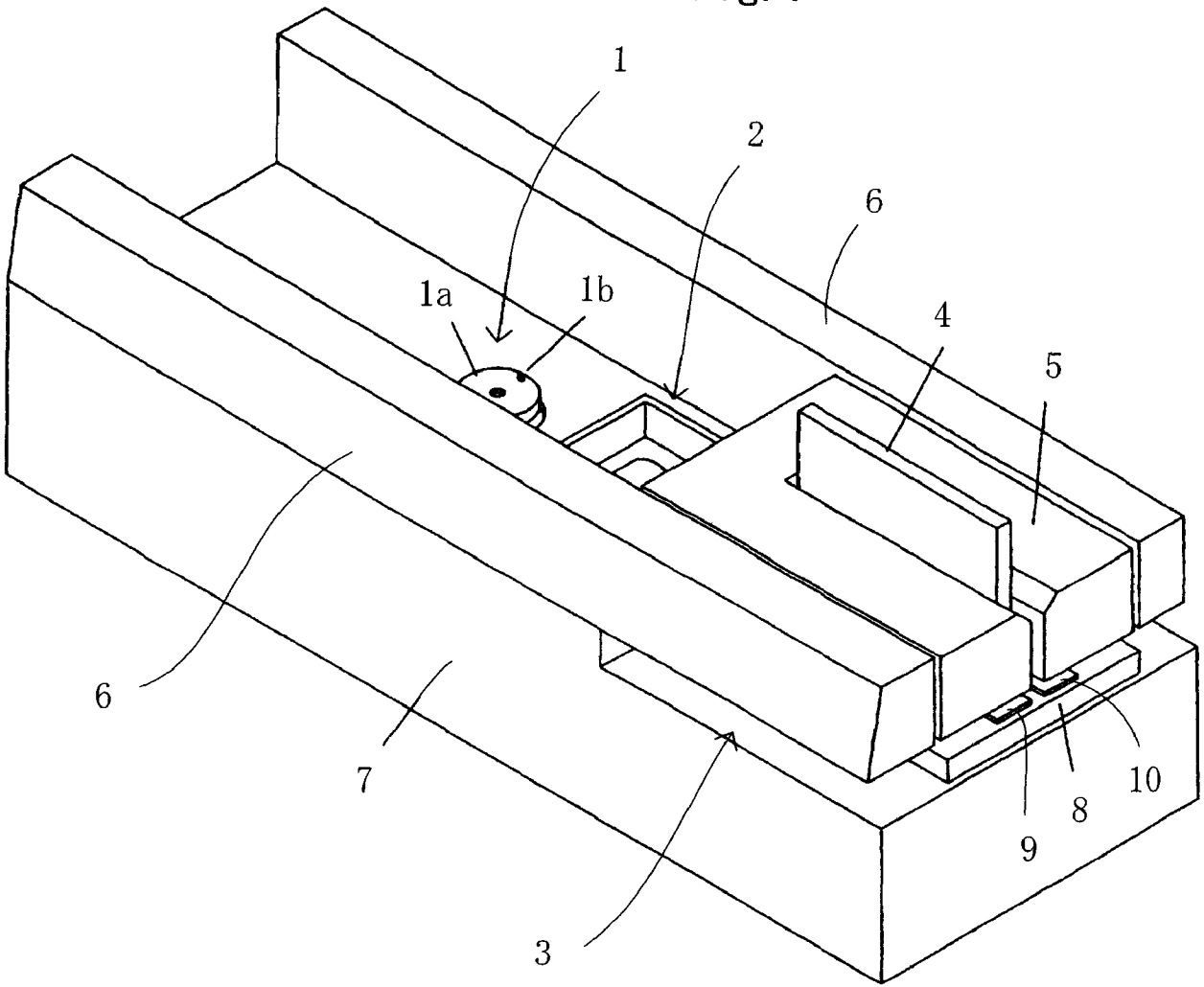
FIG. 1 is a perspective view of a book binding apparatus for perfect book binding having a machine for attachment of a cover to a book block according to the present invention, where a clamp unit is located at one end of a motion path.
Figure 2:
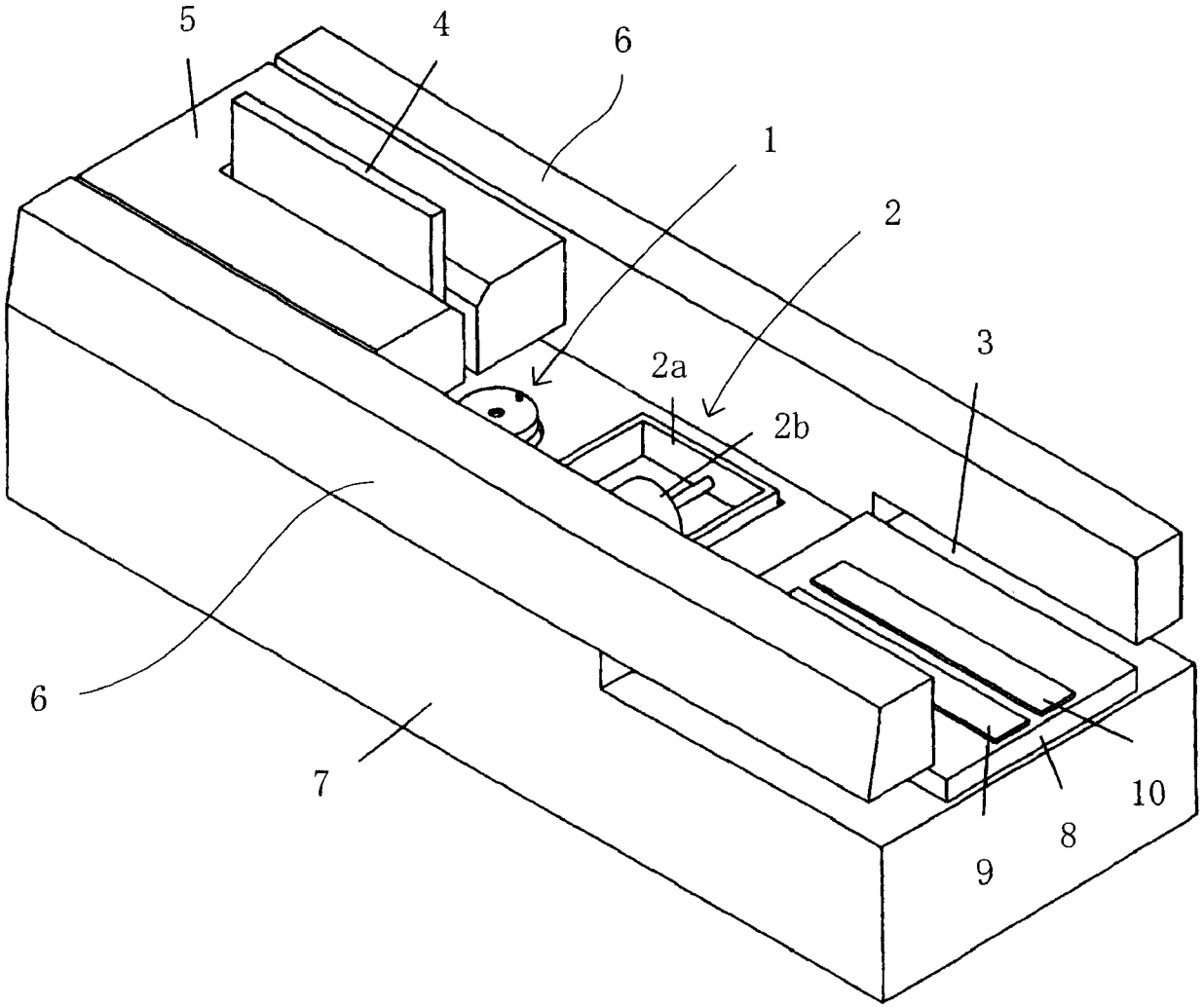
FIG. 2 is a perspective view similar to FIG. 1 when the clamp unit is located at the other end of the motion path.

A preferred embodiment of the present invention will be explained below with reference to the accompanying drawings. FIG. 1 is a perspective view of a book binding apparatus for perfect book binding having a machine for attachment of a cover to a book block according to the present invention. In FIG. 1, a clamp unit is located at one end of a motion path. FIG. 2 is a perspective view similar to FIG. 1 when the clamp unit is located at the other end of the motion path.

Referring to FIGS. 1 and 2, the book binding apparatus for perfect book binding includes a milling unit 1, a glue application unit 2, a cover attachment unit 3 comprising a machine for attachment of a cover to a book block according to the present invention, and a clamp unit 5. The milling unit 1, the glue application unit 2 and the cover attachment unit 3 are sequentially mounted in a line in a frame 7. The clamp unit 5 clamps a book block 4 at both sides thereof in a manner such that a back surface of the book block 4 is oriented downward above the line, and the clamp unit 5 moves the book block 4 along this line. In this book binding apparatus for perfect book binding, the cover attachment unit 3 also functions as a book block insertion unit for setting the book block 4 in the clamp unit 5.

Although not shown in the drawings, the clamp unit 5 includes a pair of clamping plates composed of a fixed clamping plate and a movable clamping plate, and a gap adjusting mechanism for causing the movable clamping plate to move in directions toward and away from the fixed clamping plate.

A milling unit 1 includes a milling machine 1*a* and a grinding blade 1*b* provided on the milling machine 1*a*. While the book block 4 passes through the milling unit 1, a back surface of the book block 4 is uniformly grinded by the milling machine 1*a*, and grooves with broad pitch are formed on the grinded back surface of the book block 4 by the grinding blade 1*b*.

The glue application unit 2 includes a glue tank 2*a* filled with glue such as hot-melt adhesive, and a gluing drum 2*b* provided in the glue tank 2*a*. The glue application unit 2 applies glue to a back surface of a book block 4 grinded by the milling unit 1.

Although not shown in the drawings, the glue tank 2*a* and the gluing drum 2*b* can be moved in vertical direction between a position where they are engaged with the book block 4 moved by the clamp unit 5 and a position where they retreat from the book block 4.

A pair of slide guides 6 is attached to the frame 7. The pair of slide guides 6 is arranged in parallel to each other on both sides of the line of the milling unit 1, the glue application unit 2 and the cover attachment unit 3 having the function of the book block insertion unit. The clamp unit 5 is guided by the pair of slide guides 6. The clamp unit 5 is arranged above the line of the milling unit 1, the glue application unit 2 and the cover attachment unit 3 and reciprocates between the milling unit 1 and the cover attachment unit 3. The book binding apparatus for perfect book binding also includes a control section 30 (see FIG. 6). The control section 30 controls the milling unit 1, the glue application unit 2, the cover attachment unit 3 having the function of the book block insertion unit, and the clamp unit 5.

Figure 3:
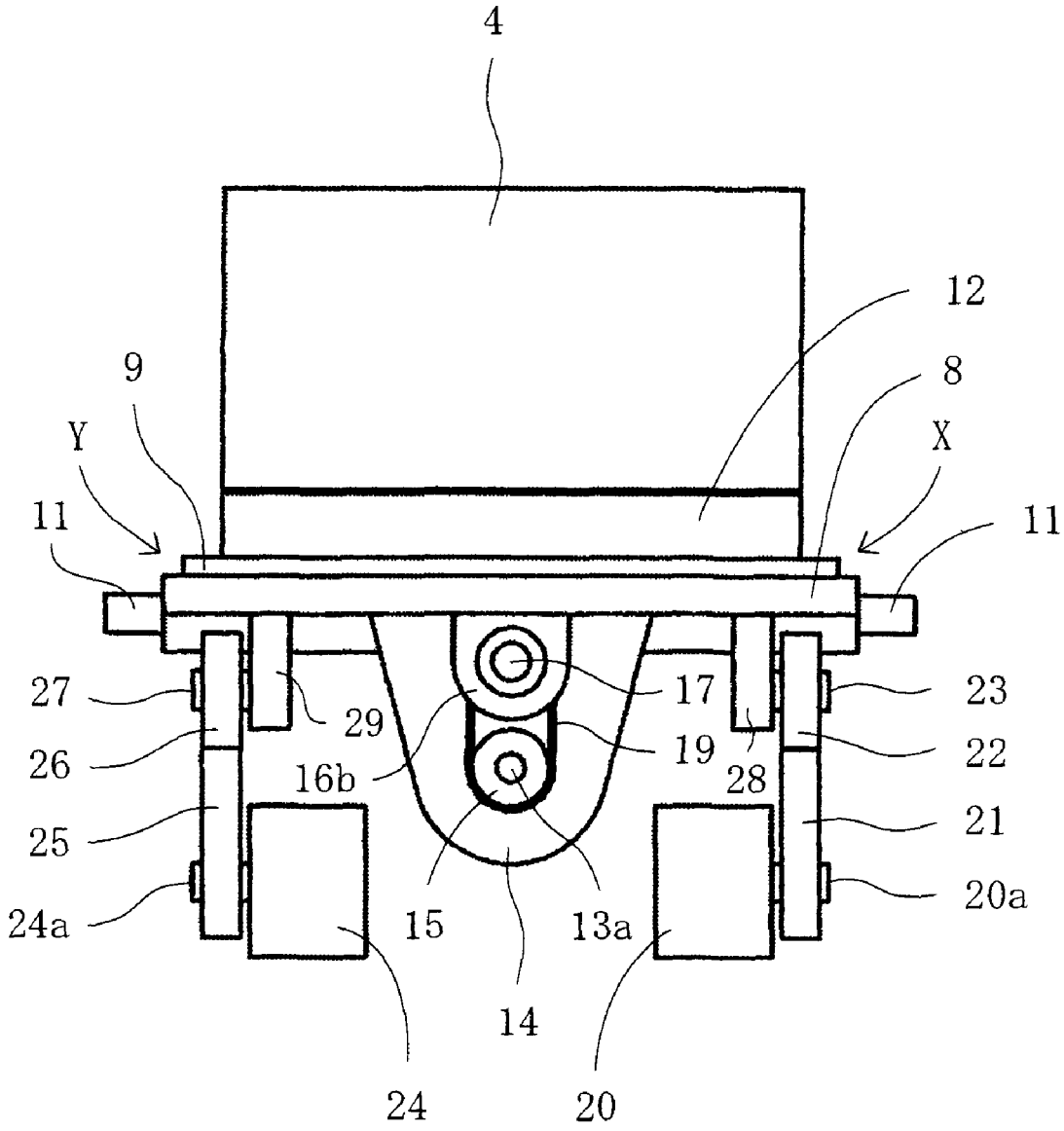
FIG. 3 is a front view showing a structure of the machine according to the present invention.

FIG. 3 is a front view of the machine for attachment of the cover to the book block according to the present invention constituting the cover attachment unit 3 which also has the function of the book block insertion unit. FIG. 4A is a perspective view showing a structure of the machine for attachment of the cover to the book block according to the present invention when the press plate is in a standby position. FIG. 4B is a perspective view showing the structure of the machine for attachment of the cover to the book block according to the present invention when the press plate is in a press position. FIG. 5A is a side view showing the structure of the machine for attachment of the cover to the book block according to the present invention when the press plate is in the standby position. FIG. 5B is a side view showing the structure of the machine for attachment of the cover to the book block according to the present invention when the press plate is in the press position.

Figure 4:
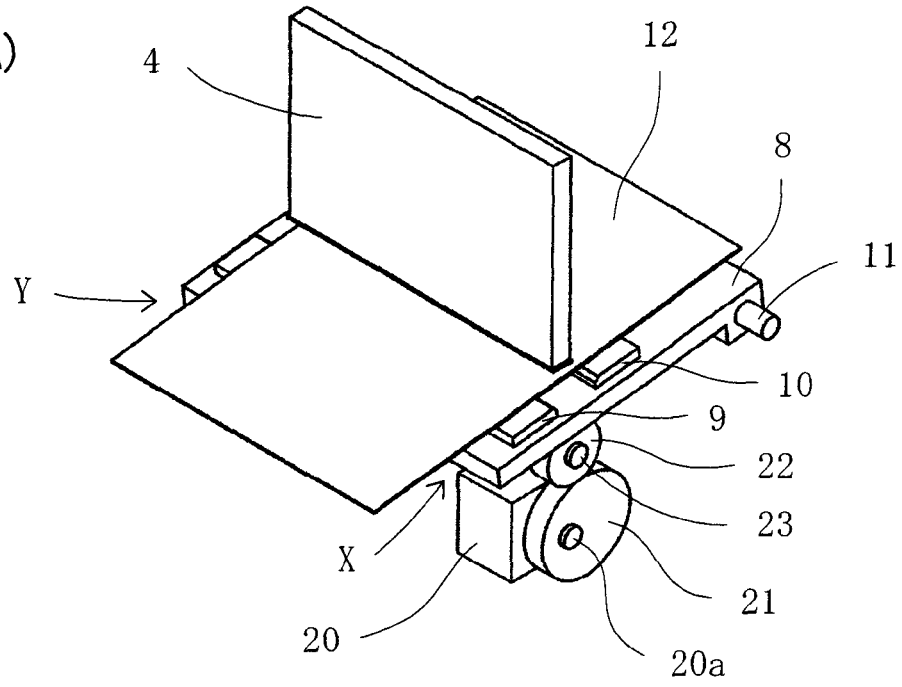
FIG. 4A is a perspective view showing a structure of the machine according to the present invention when a press plate is in a standby position.
FIG. 4B is a perspective view showing the structure of the machine according to the present invention when the press plate is in a press position.
Figure 4:
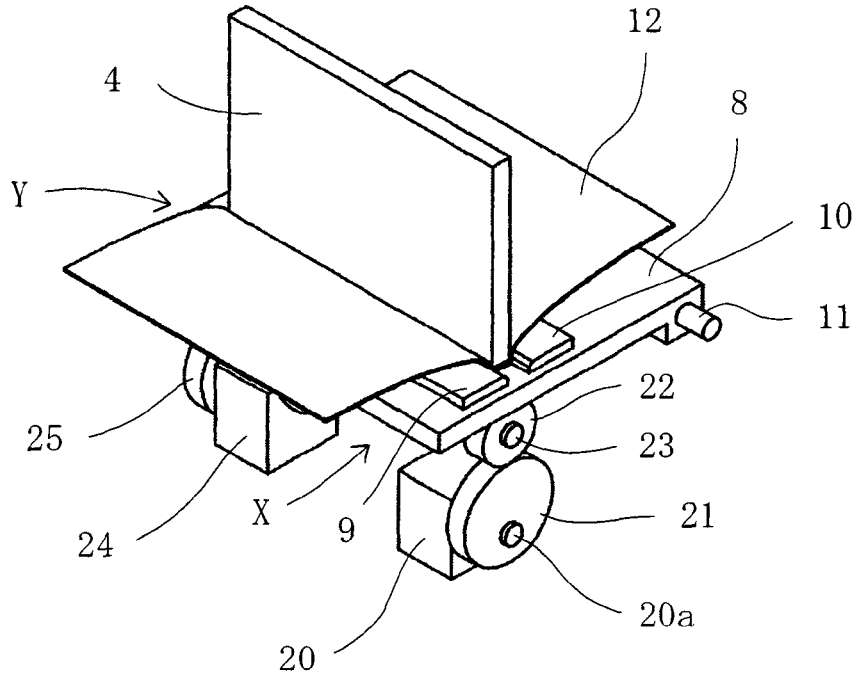
Figure 5:
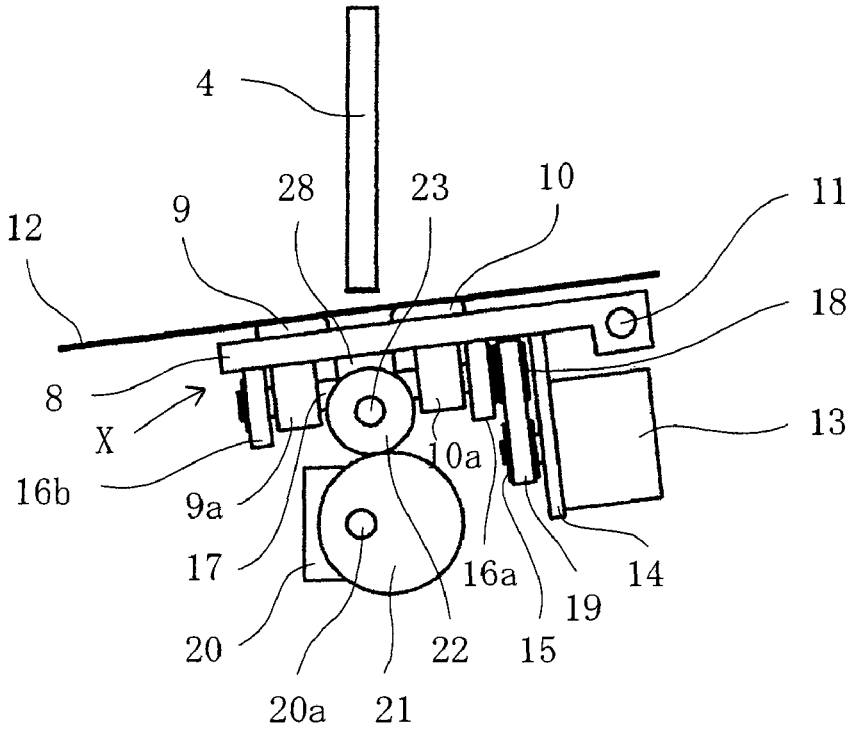
FIG. 5A is a side view showing the structure of the machine according to the present invention when the press plate is in the standby position.
FIG. 5B is a side view showing the structure of the machine according to the present invention when the press plate is in the press position.
Figure 5:
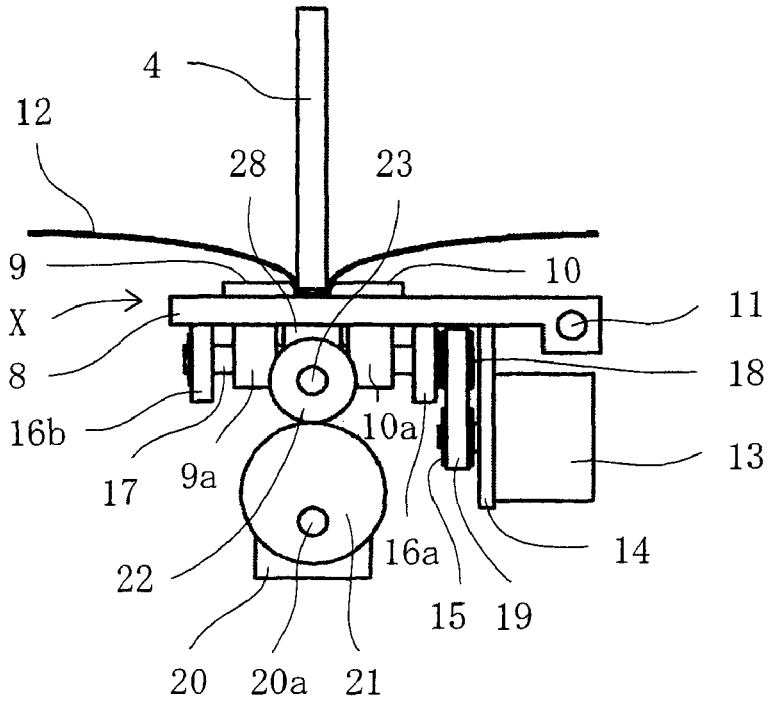

Referring to FIGS. 3 to 5, the machine for attachment of the cover to the book block of the present invention comprises a press plate 8 mounted in the frame 7 for reciprocal vertical movement between the lower end standby position and the upper end press position, a press plate elevating means mounted in the frame 7 for movement of the press plate 8, and a pair of nip plates 9 and 10 arranged on an upper surface of the press plate 8 in parallel to each other. The pair of nip plates 9 and 10 can slide in directions toward and away from each other. The machine also comprises a nip plate drive means attached to the press plate 8 for causing the pair of nip plates 9 and 10 to slide. A cover 12 is arranged at a predetermined position on the press plate 8 in a manner such that the cover 12 covers the pair of nip plates 9 and 10 and extends across the nip plates 9 and 10.

In this embodiment, the press plate 8 has a rectangular shape, and the pair of nip plates 9 and 10 is arranged in parallel to a pair of opposing side edges of the press plate 8. One of the opposed side edges of the press plate 8 is attached to the frame 7 by a shaft 11 which extends in parallel to the nip plates, so that the press plate 8 swings around an axis of the shaft 11 and vertically reciprocates. A slit (not shown) is formed on the press plate 8 in a direction across the central portion of the nip plates 9 and 10 at a right angle. A feed-screw 17 is attached to a lower surface of the press plate 8 through a pair of support members 16*a* and 16*b*. The feed-screw 17 extends in parallel to the slit. Each support member 16*a*, 16*b* has a bearing, and the feed-screw 17 is supported by the bearings for rotation around the shaft. The nip plates 9 and 10 are provided at their lower surfaces with extension portions 9*a* and 10*a*. Each extension portion 9*a*, 10*a* includes a through hole having a screw groove. The extension portions 9*a*, 10*a* project downward through the slit, and are engaged with the feed-screw 17 through the through hole. Directions of screws of the feed-screw 17 are different from each other on both sides of a position corresponding to the slit. Therefore, as the feed-screw 17 rotates, the pair of nip plates 9 and 10 can slide in directions toward and away from each other along the slit.

A vertical fixed plate 14 is mounted on a lower surface of the press plate 8 in a way that it is opposed to an end of the feed-screw 17 projecting from the support member 16*b*. A nip plate drive motor 13 is fixed to the fixed plate 14. A drive shaft 13*a* of the nip plate drive motor 13 is arranged below the feed-screw 17 in parallel thereto. A pulley 15 is mounted on the drive shaft 13*a* of the nip plate drive motor 13, and a pulley 18 is mounted on an end of the feed-screw 17 opposed thereto. An endless belt 19 is extended between the pulley 15 and the pulley 18. When the nip plate drive motor 13 is driven, the feed-screw 17 is rotated, and the pair of nip plates 9 and 10 slides along the slit. The nip plate drive motor 13 is controlled by the control section 30 (see FIG. 6).

In this embodiment, the nip plate drive means is comprised of the slit, the feed-screw 17, the pulley 15, the pulley 18, the endless belt 19 and the nip plate drive motor 13.

The press plate elevating means comprises a first elevation unit for vertically moving a first end X of the press plate 8 which is located at the top edge side of the book block 4, and a second elevation unit for vertically moving a second end Y of the press plate 8 which is located on the bottom edge side of the book block 4.

In this embodiment, a first elevation unit of the press plate elevating means comprises a first stepping motor 20 arranged below a lower side of a first end X of the press plate 8 and mounted in the frame (7), a first plate cam 21 fixed to a drive shaft 20*a* of the first stepping motor 20, a first rod 28 projecting from a lower surface of the first end X of the press plate 8, and a first roller 22 attached to a tip end of the first rod 28 through a pin 23 and abutting against an edge of the first plate cam 21 from above. When the first stepping motor 20 is driven, the first plate cam 21 rotates, so that the first rod 28 moves vertically, and the first end X of the press plate 8 moves vertically.

The second elevation unit of the press plate elevating means comprises a second stepping motor 24 arranged below the second end Y of the press plate 8 and mounted in the frame (7), a second plate cam 25 fixed to a drive shaft 24*a* of the second stepping motor 24, a second rod 29 projecting from a lower surface of the second end Y of the press plate 8, and a second roller 26 attached to a tip end of the second rod 29 by a pin 27 and abutting against an edge of the second plate cam 25 from above. When the second stepping motor 24 is driven, the second plate cam 25 rotates, so that the second rod 29 moves vertically, and the second end Y of the press plate 8 moves vertically.

Figure 6:
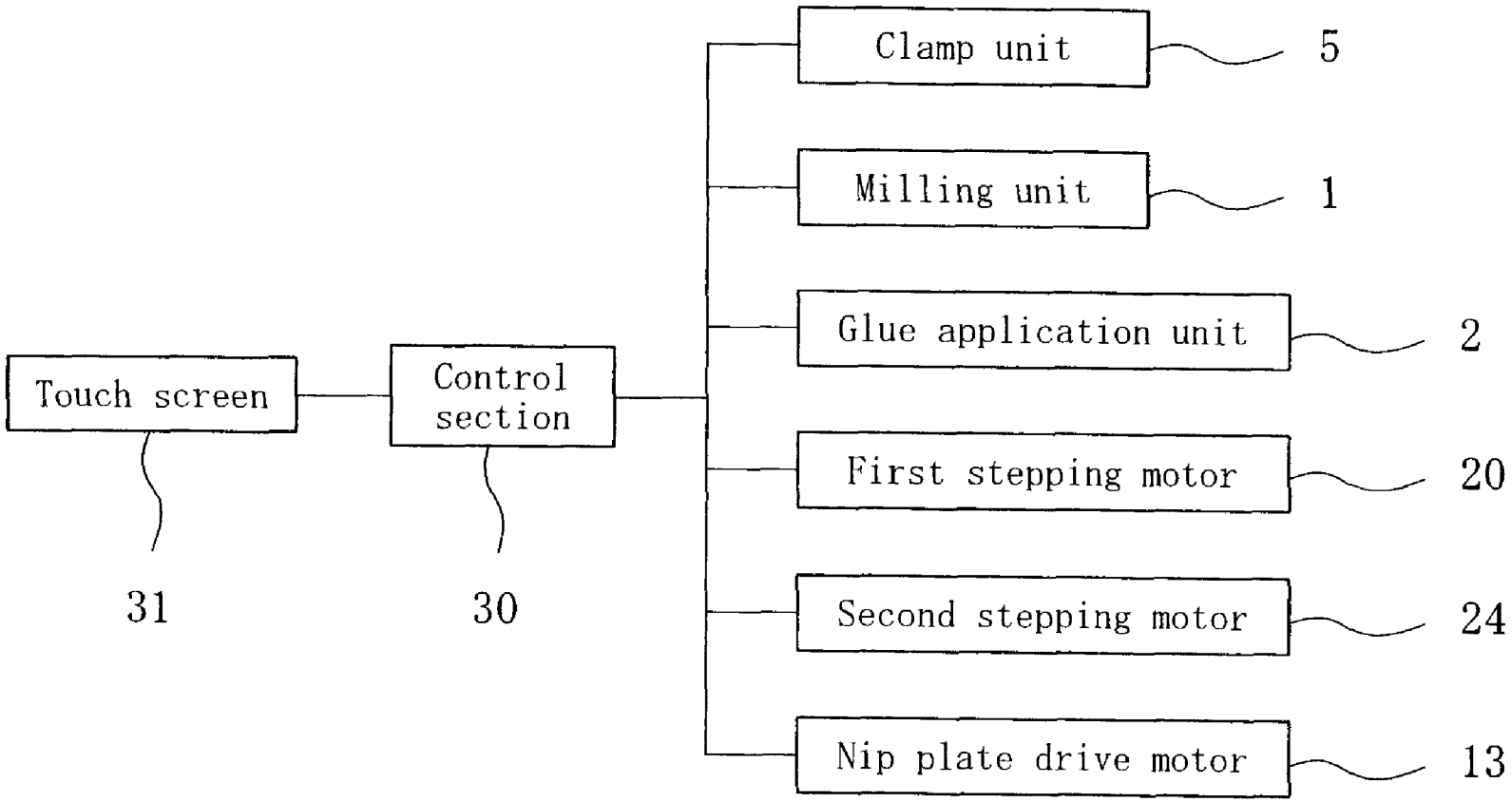
FIG. 6 is a block diagram showing a structure of a control system of the book binding apparatus for perfect book binding shown in FIG. 1.

The first and second stepping motors 20 and 24 are separately controlled by the control section 30 (see FIG. 6). Thus the height of the first and second ends X and Y of the press plate 8 at the press position can be set separately by separately setting the amount of rotation of the first and second stepping motors 20 and 24, that is, rotation angles of the first and second plate cams 21 and 25.

In other words, in the case of a book block 4 whose top edge side is thicker than the bottom edge side, the height of the first and second ends X and Y of the press plate 8 at the press position is set such that the height of the first end X is lower than that of the second end Y. Accordingly, the press plate 8 is inclined at the press position, a gap between the press plate 8 and the back surface of the book block becomes greater at the top edge side of the book block back surface with a large amount of glue, while a gap between the press plate 8 and the book block back surface becomes smaller at the bottom edge side of the book block back surface with a small amount of glue. As a result, glue does not stick out toward side surfaces of the book block and sufficiently supplied to both sides of the back surface of the book block on attachment of the cover 12 to the book block 4. In this manner, the cover 12 is attached to the book block 4 in such a manner that the cover 12 is folded along the corner of the book block back surface at a right angle, and good processing quality of cover attachment is obtained.

In the case of a book block 4 whose top edge side is thinner than the bottom edge side, the height of the first and second ends X and Y of the press plate 8 at the press position is set such that the height of the first end X is higher than that of the second end Y.

When the clamp unit 5 is located at a book block insertion unit 3 (one end of a guide rail 6) as shown in FIG. 1, the first and second stepping motors 20 and 24 receives a control signal from the control section 30 and are driven so as to move the press plate 8 to an alignment position between the standby position and the press position. The book block 4 is then inserted into the clamp unit 5 in a manner such that the back surface is directed downward, and the book block 4 is positioned by abutting the back surface against the press plate 8 located at the alignment position. Thereafter, the book block 4 is clamped by the clamp unit 5 at both sides thereof. In this case, the height of the alignment position of the press plate 8 can be easily adjusted by adjusting the amount of rotation of the drive shafts of the first and second stepping motors 20 and 24. Therefore, even if there is no mechanism which adjusts heights of the milling machine 1*a* and the grinding blade 1*b* of the milling unit 1 and adjusts heights of the glue tank 2*a* and the gluing drum 2*b* of the glue application unit 2, it is possible to easily adjust these heights with respect to the back surface of the book block 4 when the book block 4 is clamped by the clamp unit 5, and to adjust the amount of grinding of the book block 4 and the amount of glue to be applied to the book block 4.

The press plate 8 is then lowered to the standby position from the alignment position, the book block 4 clamped by the clamp unit 5 is moved from the book block insertion unit 3 to the other end of the guide rail 6 beyond the glue application unit 2 as shown in FIG. 2. During this motion, the back surface of the book block 4 is uniformly grinded, and the inclined grooves are formed in the grinded surface with a given pitch. The glue tank 2*a* and the gluing drum 2*b* of the glue application unit 2 are lowered to positions retreated from the book block 4.

When the clamp unit 5 reaches the other end of the guide rail 6, the cover 12 is arranged at a predetermined position on the press plate 8 of the cover attachment unit 3, and the glue tank 2*a* and the gluing drum 2*b* of the glue application unit 2 are moved upward to the positions where they engage with the book block 4. The book block 4 clamped by the clamp unit 5 is moved from the milling unit 1 to the cover attachment unit 3 through the glue application unit 2. During this motion, reversely inclined new grooves are formed on the back surface of the book block 4 with a given pitch in the milling unit 1, and glue is applied to the back surface of the book block 4 in the glue application unit 2.

In the cover attachment unit 3, the book block 4 clamped by the clamp unit 5 is arranged in such a manner that the back surface to which glue is applied faces a gap between the pair of nip plates 9 and 10 above the gap (see FIGS. 4A and 5A).

Thereafter, a control signal is sent to the first and second stepping motors 20 and 24 from the control section 30, so that the press plate 8 located at the standby position is moved upward to the press position together with the pair of nip plates 9 and 10, and the cover 12 is pressed against the back surface of the book block 4 by the press plate 8. A control signal is sent to the nip plate drive motor 13 from the control section 30, so that the pair of nip plates 9 and 10 clamps a lower end of the book block 4 together with the cover 12 from both sides, the cover 12 is pressed against both sides of the lower end of the book block 4, and thereby the cover 12 is attached to the book block 4 (see FIGS. 4B and 5B).

Figure 7:
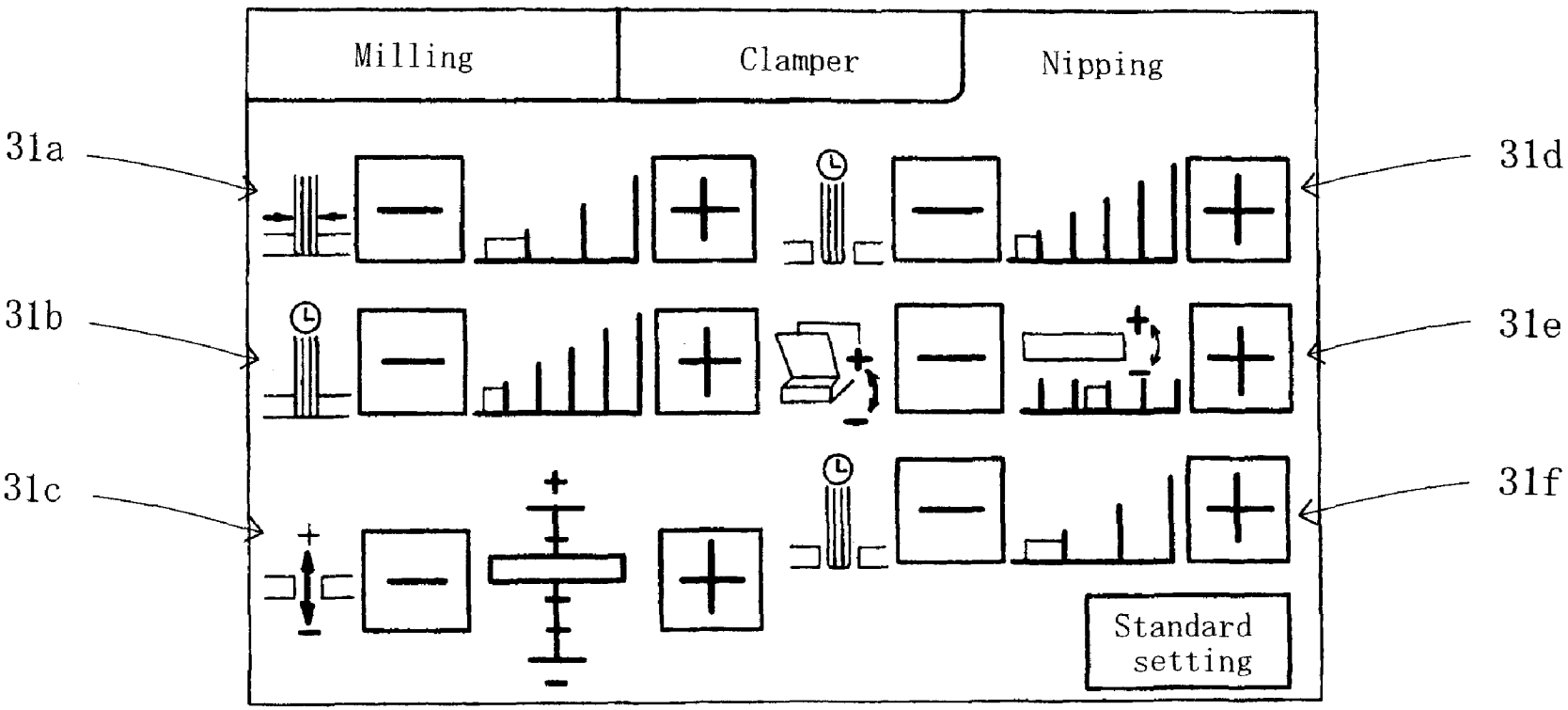
FIG. 7 is a plan view showing a screen displayed on a touch screen provided in the control section of the machine for attachment of the cover to the book block according to the present invention.
Figure 8:
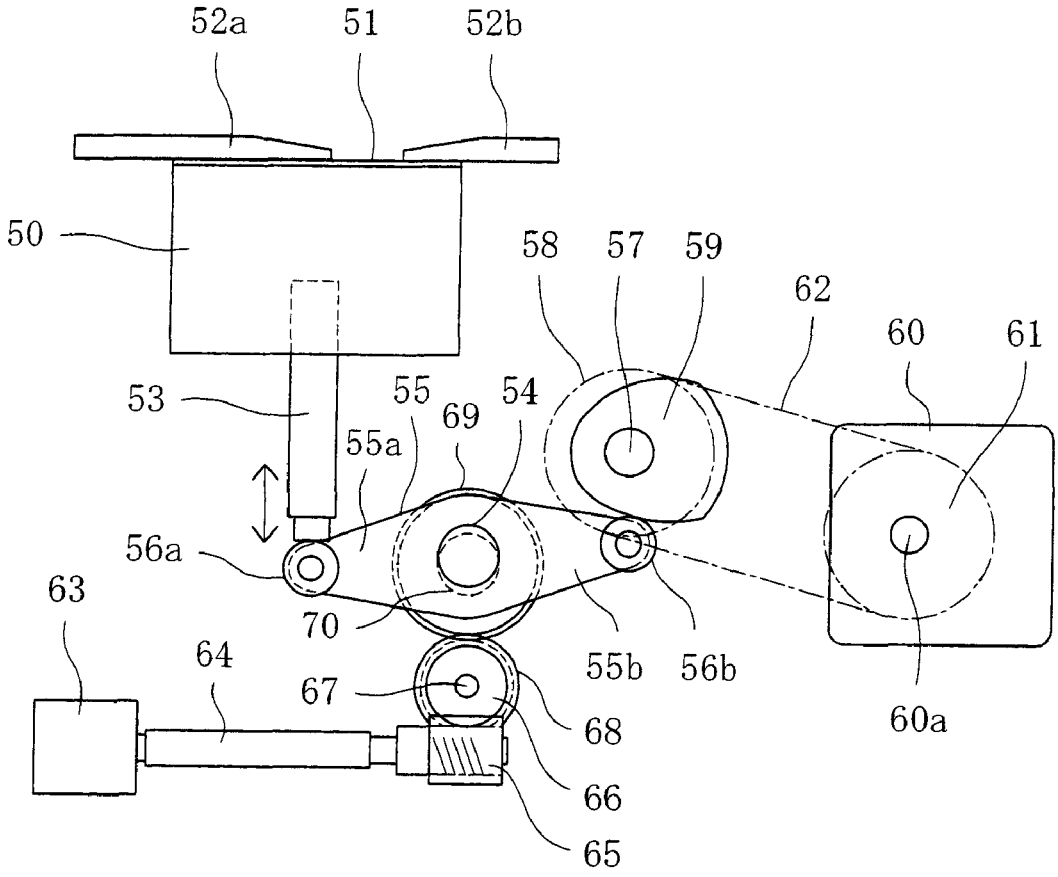
FIG. 8 is a side view showing a structure of a conventional machine for attachment of a cover to a book block.

In this embodiment, the control section 30 includes a touch screen 31 as shown in FIG. 6. The touch screen 31 displays a setting screen for carrying out various setting operation required for operation of the book binding apparatus for perfect book binding. FIG. 7 shows one example of the setting screen displayed on the touch screen 31. In the setting screen shown in FIG. 7, it is possible to carry out the setting operation at the time of the milling operation, the clamping operation and the nipping operation by switching tags of "Milling", "Clamper" and "Nipping".

As shown in FIG. 7, the nipping setting screen has a screen region 31*a* for setting strength of clamping the book block 4 by the pair of nip plates 9 and 10, a screen area 31*b* for setting time of clamping the book block 4 by the pair of nip plates 9 and 10, a screen area 31*c* for setting height of an alignment position of the press plate 8, a screen area 31*d* for setting the waiting time elapsed before the cover attachment operation is completed after the clamping of the book block 4 by the pair of nip plates 9 and 10 is completed, a screen area 31*e* for setting inclination (heights of an end on the back side and an end on the bottom edge side) of the press plate 8 at the press position when thicknesses of the back side and the bottom edge side of the book block 4 are different from each other, and a setting screen 31*f* for setting the waiting time elapsed before the cover attachment operation is completed after the clamping of the book block 4 by the pair of nip plates 9 and 10 is completed when the cover 12 is not attached to the book block 4. Each of the screen regions 31*a* to 31*f* has a "+" button for increasing a set value and a "−" button fore decreasing the set value. The set values can easily be inputted by pressing these buttons. For example, in the screen area 31*e*, the first end (top edge side) X of the press plate 8 can become higher than the second end (bottom edge side) Y at the press position by pressing the "+" button, and, on the other hand, the first end (top edge side) X of the press plate 8 can become lower than the second end (bottom edge side) Y at the press position by pushing the "−" button.

Although not shown in the drawings, a height of the alignment position of the press plate 8 of the book block insertion unit 3 can be set on the milling setting screen, and a strength of the clamp unit 5 for clamping the book block 4 and a speed of motion of the clamp unit 5 can be set on the clamper setting screen.

A set value inputted from the touch screen 31 is stored in a memory (not shown) of the control section 30. Based on the set value stored in the memory, the milling unit 1, the glue application unit 2 and the clamp unit 5 are controlled as well as the first and second stepping motors 20 and 24 and the nip plate drive motor 13 are controlled.

The above-described embodiment is merely one preferable embodiment of the present invention, and the structure of the present invention is not limited to this embodiment.

For example, in the embodiment, the press plate elevating means is the cam apparatus, but the press plate elevating means may be a liquid-pressure cylinder apparatus instead of the cam apparatus. In this case, the first elevation unit of the press plate elevating means comprises a first liquid-pressure cylinder arranged below the first end of the press plate and a first pressure control means for operating the first liquid-pressure cylinder. A main body of the first liquid-pressure cylinder is fixed to the frame, and a tip end of a piston rod is connected to a lower surface of the first end of the press plate, and the first end of the press plate is vertically moved by reciprocal motion of the piston rod of the first liquid-pressure cylinder. Further, the second elevation unit of the press plate elevating means comprises a second liquid pressure cylinder arranged below the second end of the press plate, and a second pressure control means for operating the second liquid pressure cylinder. A main body of the second liquid pressure cylinder is fixed to the frame, and a tip end of the piston rod is connected to a lower surface of the second end of the press plate, and the second end of the press plate is vertically moved by reciprocal motion of the piston rod of the second liquid pressure cylinder. The first and second pressure control means are separately controlled by the control section, so that the height of each of the first and second ends of the press plate at the press position can be set separately.

In the above-mentioned embodiment, the machine for attachment of the cover to the book block of the present invention is applied to the cover attachment unit of the book binding apparatus for perfect book binding, but the machine of the present invention may be used as a single apparatus for attachment of a cover to a book block.

The invention claimed is:

1. A machine for attachment of a cover to a book block, comprising:

a frame (7);

a press plate (8) attached to the frame (7) for reciprocal vertical movement between a lower end standby position and an upper end press position;

a press plate elevating means mounted in the frame (7);

a pair of nip plates (9, 10) arranged on an upper surface of the press plate (8) in parallel to each other for sliding in directions toward and away from each other;

a nip plate drive means attached to the press plate (8) for causing the pair of nip plates (9, 10) to slide;

a clamp unit (5) mounted in the frame (7) for clamping a book block (4) at both sides thereof in a way that a back surface of the book block (4) is directed downward, glue being previously applied to the back surface of the book block (4), the clamp unit (5) arranging the book block (4)

above a gap between the pair of nip plates (9, 10) in a manner such that the back surface of the book block (4) faces the gap, a cover (12) being arranged on the press plate (8), the cover (12) covering the pair of nip plates (9, 10) and crossing the pair of nip plates (9, 10); and a control section (30) sending a control signal to the press plate elevating means and the nip plate drive means so as to upwardly move the press plate (8) from the standby position to the press position together with the pair of nip plates (9, 10) and press the cover (12) against the back surface of the book block (4) by the press plate (8) and thereafter, in the press position, nip a lower end of the book block (4) at both sides thereof together with the cover (12) by the pair of nip plates (9, 10) and press the cover (12) against side surfaces of the lower end of the book block (4), thereby attaching the cover (12) to the book block (4), wherein the press plate (8) is supported by a shaft (11) rotatably around an axis of the shaft (11) at a portion thereof which is separated from the gap between the pair of nip plates (9,10) by a distance in a direction intersecting at a right angle with the nip plates (9,10), the shaft (11) being attached to the frame (7) and extending in parallel to the nip plates (9,10), whereby the first and second ends (X,Y) of the press plate (8) are vertically reciprocated by the first and second elevation units, respectively;

wherein the press plate elevating means comprises:

a first elevation unit for vertically moving a first end (X) of the press plate (8), the first end (X) being located at a top edge side of the book block (4); and a second elevation unit for vertically moving a second end (Y) of the press plate (8), the second end (Y) being located at a bottom edge side of the book block (4), and wherein the first and second elevation units are separately controlled by the control section (30) so that the height of each of the first and second ends (X, Y) of the press plate (8) at the press position can be set separately.

2. The machine according to claim 1, wherein the first elevation unit of the press plate elevating means comprises:

a first stepping motor (20) arranged below the first end (X) of the press plate (8) and mounted in the frame (7);

a first plate cam (21) fixed to a drive shaft (20*a*) of the first stepping motor (20);

a first rod (28) projecting from a lower surface of the first end (X) of the press plate (8); and a first roller (22) attached to a tip end of the first rod (28) and abutting against an edge of the first plate cam (21) from above, and wherein the second elevation unit of the press plate elevating means comprises:

a second stepping motor (24) arranged below the second end (Y) of the press plate (8) and mounted in the frame (7);

a second plate cam (25) fixed to a drive shaft (24*a*) of the second stepping motor (24);

a second rod (29) projecting from a lower surface of the second end (Y) of the press plate (8); and a second roller (26) which is provided on a tip end of the second rod (29) and which abuts against an edge of the second plate cam (25) from above, and wherein the first and second stepping motors (20, 24) are separately controlled by the control section (30), so that the height of each of the first and second ends (X, Y) of the press plate (8) in the press position can be set separately.

3. The machine according to claim 2, wherein the control section (30) includes a touch screen (31) for inputting a value of the height of each of the first and second ends (X, Y) of the press plate (8) in the press position, and the first and second stepping motors (20, 24) are controlled based on the value of the height inputted from the touch screen (31).

4. The machine according to claim 1, wherein the first elevation unit of the press plate elevating means comprises:

a first liquid-pressure cylinder arranged below the first end (X) of the press plate (8); and a first pressure control means for operating the first liquid-pressure cylinder, a main body of the first liquid-pressure cylinder being fixed to the frame (7), a tip end of a piston rod being connected to a lower surface of the first end (X) of the press plate (8), the first end (X) being vertically moved by reciprocal motion of the piston rod of the first liquid- pressure cylinder, and wherein the second elevation unit of the press plate elevating means comprises:

a second liquid pressure cylinder arranged below the second end (Y) of the press plate (8); and a second pressure control means for operating the second liquid pressure cylinder, a main body of the second liquid pressure cylinder being fixed to the frame (7), a tip end of a piston rod being connected to a lower surface of the second end (Y) of the press plate (8), the second end (Y) being vertically moved by reciprocal motion of the piston rod of the second liquid pressure cylinder, and wherein the first and second pressure control means are separately controlled by the control section (30), so that the height of each of the first and second ends (X, Y) of the press plate (8) at the press position can be set separately.

5. The machine according to claim 4, wherein the control section (30) includes a touch screen (31) for inputting a value of the height of each of the first and second ends (X, Y) of the press plate (8) in the press position, and the first and second stepping motors (20, 24) are controlled based on the value of the height inputted from the touch screen (31).

* * * * *